US005918748A

United States Patent [19]

Clark et al.

[11] Patent Number: 5,918,748

[45] Date of Patent: Jul. 6, 1999

[54] AUTOMATIC TELLER MACHINES

[75] Inventors: Barrie Clark; Robert D. Andrew, both of Dundee, United Kingdom

[73] Assignee: NCR Corporation, Dayton, Ohio

[21] Appl. No.: 08/886,484

[22] Filed: Jul. 1, 1997

[30] Foreign Application Priority Data

Nov. 29, 1996 [GB] United Kingdom ..... 9624895

[51] Int. Cl.[6] ..... B07C 5/00; B07C 5/02; B07C 5/342

[52] U.S. Cl. ..... 209/534; 209/583; 209/3.3; 209/569

[58] Field of Search ..... 209/534, 583, 209/3.3, 569, 939

[56] References Cited

U.S. PATENT DOCUMENTS 4,402,410 9/1983 Ohba et al. ..... 209/534
4,458,816 7/1984 Horino et al. ..... 209/534
5,422,467 6/1995 Graef et al. ..... 209/569
5,555,983 9/1996 Yamagishi ..... 209/534

FOREIGN PATENT DOCUMENTS 0644511 3/1995 European Pat. Off. .
3933819 4/1991 Germany .

*Primary Examiner*—William E. Terrell
*Assistant Examiner*—Joe Dillon, Jr.
*Attorney, Agent, or Firm*—Michael Chan

[57] ABSTRACT

An automatic teller machine has an input hopper (20) into which checks and banknotes for deposit can be put. An imaging and sorting device (22) separates the banknotes and checks from each other. The banknotes are fed to a temporary banknote storage device (24) and the checks are fed to a temporary check storage device (26). A receipt for the number of items of each kind deposited is issued to the depositor. A further imaging device (28) may be provided for subsequent more detailed examination and further sorting of the deposited items. The subsequent examination preferably takes place when the machine is not being used by a customer.

10 Claims, 1 Drawing Sheet

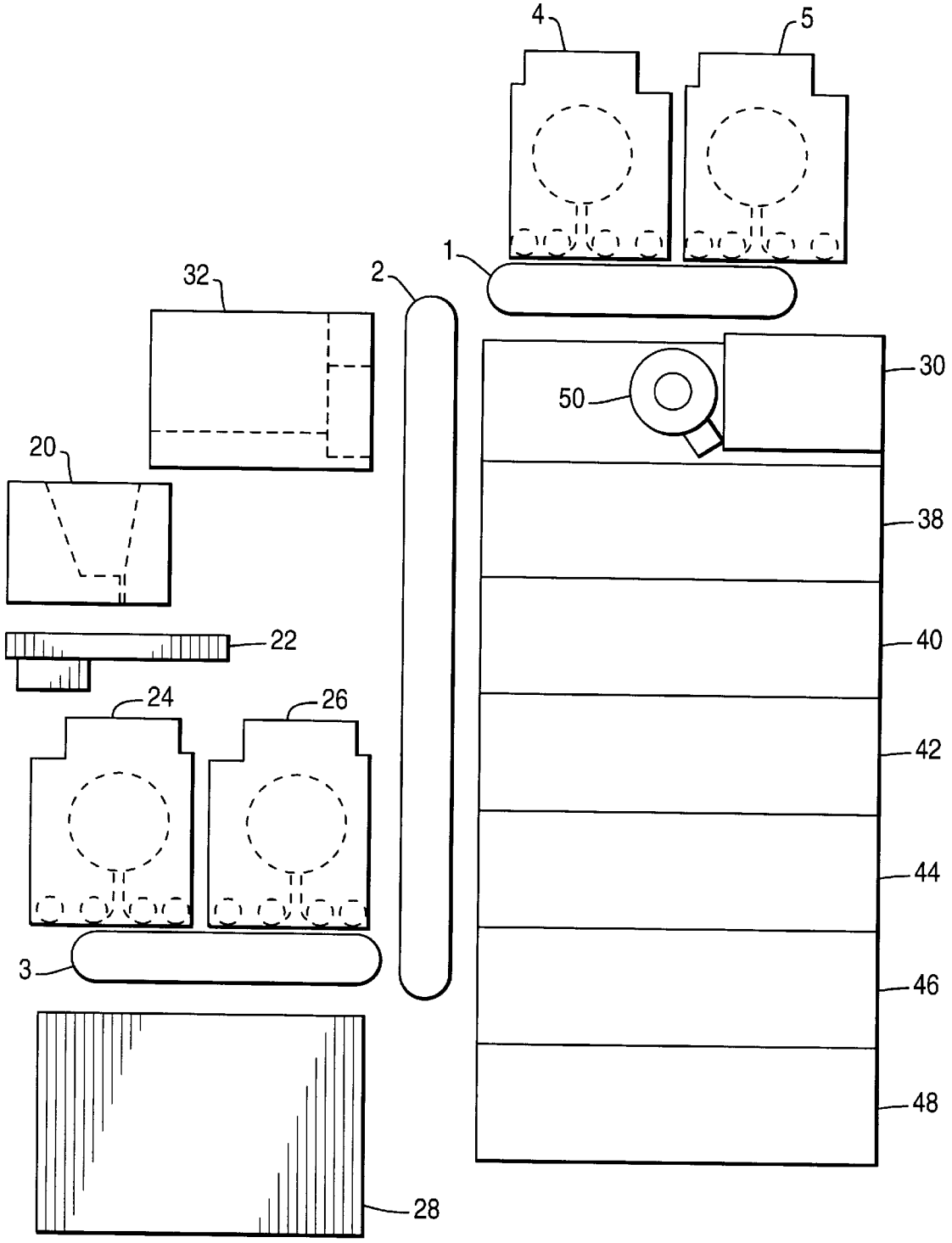
4
5
1
2
32
30
50
20
38
22
40
24
26
42
44
3
46
48
28

AUTOMATIC TELLER MACHINES

BACKGROUND OF THE INVENTION

This invention relates to automatic teller machines (ATMs).

Now that ATMs enjoy wide acceptance by customers of banks it is desirable to provide facilities for the automatic deposit of the kind of items of bank business, such as banknotes and cheques, which are accepted by bank tellers. Such automatic deposit facilities are known. The known facilities are one of two kinds. In one kind of facility the customer puts all the items he wishes to deposit into a special envelope and inserts the envelope into a designated slot in an ATM. A receipt is given, basically just for the envelope. The contents of the envelope are later processed manually in the traditional way. In the other kind of facility individual items are deposited and are then examined with the aid of an imaging device. A detailed receipt is then issued to the waiting customer. However the detailed examination of each item takes time and during that time the ATM is unavailable for use by any other customer. This reduces the number of customers that an ATM can handle in a given time and so its usefulness.

SUMMARY OF THE INVENTION

It is an object of the invention to reduce the time in which a customer needs to spend at an ATM while still providing an attractive service.

According to the invention there is provided an automatic teller machine comprising an input device into which items can be deposited, characterized by an imaging and sorting device for examining deposited items to determine whether they are banknotes or cheques and sorting the items into two groups, one group comprising banknotes and the other group comprising cheques, temporary storage devices for storing the two groups of sorted items, and a printer for issuing receipts showing the respective number of items sent to the storage devices.

In an ATM embodying the invention the speed of issue of a receipt will be much faster than the time taken to issue a detailed receipt. Thus the period of perceived use of an ATM by a customer will be reduced. On the other hand the customer will find that such a receipt will be more reassuring than a receipt for a mere envelope the contents of which are unspecified.

Preferably a further imaging device is also included for subsequent examination of the contents of the temporary storage devices. Means may also be provided for carrying out banking transactions on the items viewed by the further imaging device. Such transactions may include printing endorsements on the cheques and further sorting of the banknotes into denominations and quality. The subsequent examination preferably takes place when the machine is not being used by a customer.

BRIEF DESCRIPTION OF THE DRAWINGS

In order that the invention may be more fully understood reference will now be made to the accompanying drawings in which FIG. 1 is a diagrammatic view of the main operating parts of an automatic teller machine embodying the invention.

FIG. 1 shows a receiving arrangement by means of which banknotes and cheques may be deposited by a customer. Items for deposit are put into input hopper 20. They are transferred from there to an imaging and sorting device 22 where the banknotes and cheques are separated, with banknotes going to a temporary banknote storage device 24 and cheques going to a temporary cheque storage device 26. Devices 24 and 26 may take a variety of physical forms. Examples are storage stacks, a circulating storage device such as a belt or drum, or a device employing one or more spiral belts. Devices 24 and 26 are chosen to have low inertia so that they receive items as fast as possible so reducing overall transaction times. The storage devices can be of the kind that dispense items either on a "last in first out" (LIFO) or on a "first in first out" (FIFO) basis.

DETAILED DESCRIPTION

A further imaging device 28 is provided for a more detailed examination of the banknotes held in storage device 24 and of the cheques held in cheque store 26. Banknote examination may include sorting them into their denominations and/or into quality. Cheque examination may include reading the machine readable information printed on a cheque and possibly also the handwritten information. The cheques may be endorsed and sorted.

FIG. 1 also shows a mechanism for delivering banknotes speedily to a collection point 32. Stacks of banknotes are held in cassettes 38, 40, 42, 44, 46 and 48. The different cassettes may hold notes of the same or different denominations as considered appropriate, in anticipation of demand. Known picker devices (not shown) are provided for extracting notes from the cassettes. These devices may include vacuum-operated moveable suction pads. A transport mechanism comprising a linked set of conveyer belts having three linked sections 1, 2 and 3 transports notes from the picker devices to their destination. In a conventional ATM this destination will be collection point 32. However the mechanical complexity of removing notes from the cassettes and transferring them to the transport mechanism is a limiting factor in the speed of transfer and introduces a delay that is noticeable to the customer. To reduce the delay two additional auxiliary stores 4 and 5 are provided. These stores are similar in their construction to the temporary storage devices 24 and 26.

The three linked conveyer belt sections 1, 2 and 3 have various functions. Notes extracted from the cassettes by extraction means (not shown) driven by a motor 50 are loaded onto section 2. They can be transported from section 2 either to collection point 32 or else to the appropriate one of auxiliary stores 4 and 5. Notes can also be withdrawn from either one of stores 4 or 5 and deposited onto section 1 of the conveyer belt. From section 1 notes can be transported to collection point 32.

The third section 3 of the conveyor belt operates to transfer notes, if they are of appropriate denominations as determined by imaging device 28, from the temporary banknote storage device 24 to auxiliary stores 4 and 5 when vacancies occur in those stores. Carrying out such a transfer in preference to the removal of notes from the main store may be preferable.

In operation, a customer deposits items of the kind that would be handed to a bank teller, and more specifically banknotes and cheques, into input hopper 20. He will have a card carrying personal bank account information encoded on it by a suitable encoding medium such as a magnetic stripe. The card is inserted into a slot (not shown) and the customer may also be required to enter a personal identification number (PIN) through a keyboard provided for that purpose. This procedure is designed to ensure that the correct account is credited with the items deposited. The deposited items are then examined in imaging and sorting device 22. Banknotes are sent to banknote storage device 24 and cheques to cheque storage device 26. A tally of the numbers of items of the two types is then printed and issued to the customer as a receipt. This operation is rapid so that the customer has not long to wait before his receipt is issued.

A further store 30 is also provided, and may be a multi-compartment bin. One compartment is used to store any note received by the temporary banknote storage device 24, and not required for recirculation, e.g. large denomination notes. Another compartment is used as a purge bin for mispicked notes. The further store 30 is loaded by Section 1 of the conveyor belt system.

What is claimed is:

1. An automatic teller machine (ATM) comprising:

an input device into which items can be deposited;

an imaging and sorting device which sorts based on captured images and for (i) examining deposited items to determine whether the deposited items are banknotes or cheques, and (ii) sorting the deposited items into a group comprising banknotes and another group comprising cheques;

temporary storage devices for storing the two groups of sorted items; and a printer for issuing receipts showing the respective number of items sent to the storage devices.

2. An ATM according to claim 1, further comprising an imaging device for subsequent examination of the contents of the temporary storage devices.

3. An ATM according to claim 2, wherein the imaging device examines the contents of the temporary storage devices during times of non-use by customers.

4. An ATM according to claim 3, wherein the imaging device examines the contents of the temporary storage device containing banknotes for denomination.

5. An ATM according to claim 4, further comprising (i) banknote storage devices for storing banknotes of individual denominations, and (ii) transport means for conveying sorted banknotes from the imaging device to the banknote storage devices depending upon the denomination of the banknotes.

6. A method of handling deposited items including banknotes or cheques at an automated teller machine (ATM), the method comprising the steps of:

(a) examining deposited items to determine whether the deposited items are banknotes or cheques;

(b) sorting the deposited items of step (a) by means of a device which sorts based on captured images, into a group comprising banknotes and another group comprising checks;

(c) storing the two groups of sorted items of step (b) in storage devices; and (d) printing receipts showing the respective number of items sent to the storage devices.

7. A method according to claim 6, further comprising the step of:

(e) examining the contents of the temporary storage devices by means of an additional imaging device.

8. A method according to claim 7, wherein step (e) includes the step of:

(e-1) examining the contents of the temporary storage devices during times of non-use by customers.

9. A method according to claim 8, wherein step (e-1) includes the step of:

(e-1—1) examining the contents of the temporary storage device containing banknotes for denomination.

10. A method according to claim 9, further comprising the step of:

(f) conveying sorted banknotes to banknote storage devices depending upon the denomination of the banknotes.

* * * * *